US005271683A

United States Patent [19]

Snetting et al.

[11] Patent Number: 5,271,683

[45] Date of Patent: Dec. 21, 1993

[54] ROLLER ARM GUIDE FOR HAND-HELD PAINT GUN

[75] Inventors: Mark E. Snetting; Steven A. Anderson, both of Eden Prairie, Minn.

[73] Assignee: Wagner Spray Tech Corporation, Minneapolis, Minn.

[21] Appl. No.: 918,553

[22] Filed: Jul. 29, 1992

[51] Int. Cl.[5] ..... B05C 17/02

[52] U.S. Cl. ..... 401/195; 401/197; 239/289; 239/390; 239/525; 248/315

[58] Field of Search ..... 239/289, 390, 526, DIG. 14, 239/525; 401/197, 195; 248/223.4, 314, 315

[56] References Cited

U.S. PATENT DOCUMENTS

| | | | |
|---|---|---|---|
| 553,940 | 2/1896 | Rollandet et al. | 239/390 |
| 2,822,615 | 2/1958 | Durst et al. | 248/223.4 X |
| 3,631,572 | 1/1972 | Lange | 248/233.4 X |
| 4,883,227 | 11/1989 | Maas | 239/289 X |

*Primary Examiner*—Steven A. Bratlie

*Attorney, Agent, or Firm*—Faegre & Benson

[57] ABSTRACT

A roller arm guide allows conversion of a paint spray gun for use as a paint roller, with optional attachment of an in-line cartridge filter. A track on the base of the spray gun retains a channel member on the elongate body of the roller arm guide. A filter support ring at the proximal end of the roller arm guide provides support for a conventional in-line filter and a crescent shaped roller arm engaging lip on the exterior of the filter support ring provides support for a paint roller arm.

12 Claims, 2 Drawing Sheets

ROLLER ARM GUIDE FOR HAND-HELD PAINT GUN

This invention relates to the field of portable painting equipment, more particularly to high pressure, airless painting equipment, equipped with a spray gun to deliver paint through a spray outlet nozzle. The present invention provides a detachable roller arm guide which allows the gun to be converted from use as a spray gun to use as a paint roller. In use, the spray nozzle is removed from the paint outlet fitting of the gun, the roller arm guide is slid onto a track on the base of the gun body and supports in operable position a roller arm, which is also attached to the paint outlet fitting. The roller arm guide is designed so that it may also optionally support an in-line cartridge filter. When the gun is used with the paint roller, triggering the gun delivers paint under pressure to the interior of the roller through the paint outlet fitting, thus providing a controllable supply of paint to the roller.

BACKGROUND OF THE INVENTION

High pressure airless painting equipment, particularly of the type generally available to the individual consumer, usually delivers paint in spray form through a nozzle. Although spray application of paint, varnish, stain, shellac and other such surface treatment products is suitable for many situations, the ability to easily adapt a single piece of painting equipment for both spray and roller application immensely enhances its versatility. It is also convenient for the user to have the option of adding an in-line filter to the spray gun for either spray or roller application.

DESCRIPTION OF THE PRIOR ART

Currently available from Wagner Spray Tech Corporation is a high pressure airless sprayer, Model 425, which uses a Model G-05 spray gun. Model G-05 spray gun 42 is illustrated in FIGS. 2 and 3, showing that either roller arm 16 or in-line cartridge filter 18, but not both simultaneously, can be attached by means of support ring 44 on the base of spray gun 42. Model G-05 spray gun 42 can be used interchangeably with either a spray tip (not shown) or roller attachment 16. When Model G-05 spray gun 42 is used with a spray tip, the user has the option of either using or omitting in-line cartridge filter 18 to further refine the spray product. However, when roller arm attachment 16 is used with Model G-05 spray gun 42, it is not possible to also use filter 18.

In addition to not permitting the simultaneous use of both roller arm attachment 16 and filter 18, support ring 44 on Model G-05 spray gun 42 has other disadvantages. Since Model G-05 spray gun 42 is designed with support ring 44 integral with the body of the gun, ring 44 itself, when not used for supporting either in-line filter 18 or roller arm 16, is subject to accidental breakage. Further, Model G-05 spray gun 42, as molded, is formed with certain crevices and ridges on the interior surface of support ring 44, which are difficult to clean when occluded with paint or other surface treatment product.

DETAILED DESCRIPTION OF THE INVENTION

Figure 1:
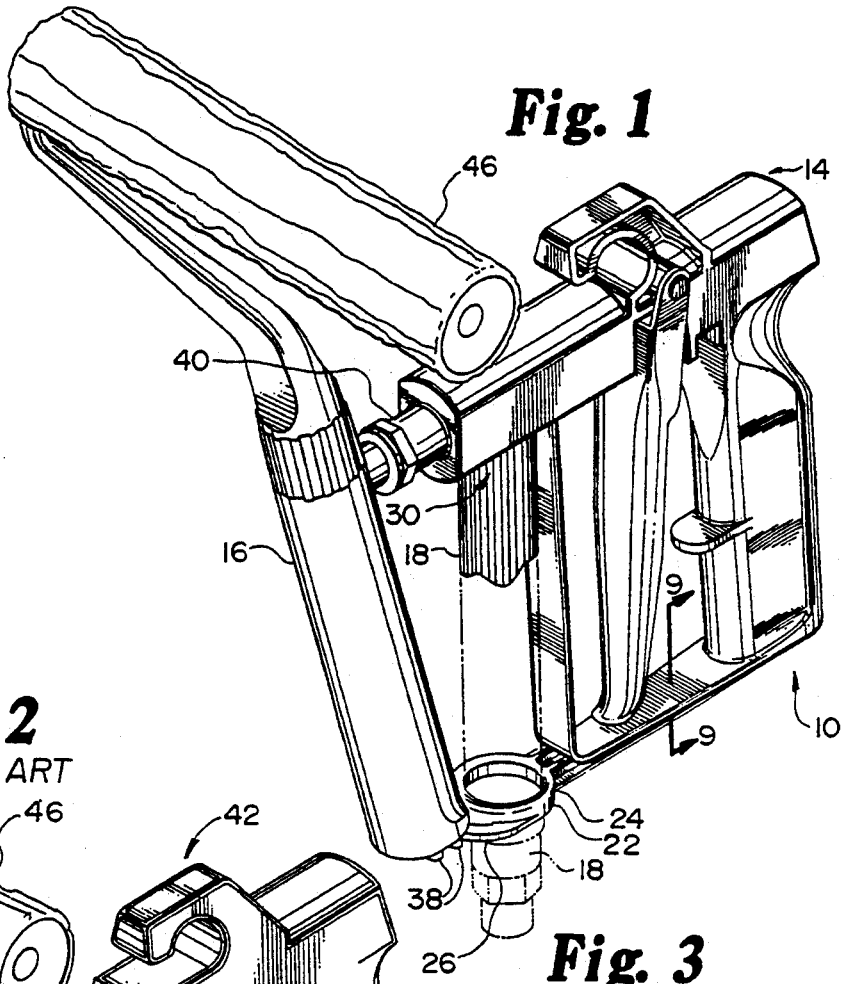
FIG. 1 is a perspective view of a roller arm guide according to the present invention, shown in position on a track on a base of a spray gun handle, with a roller handle attached, and an optional in-line cartridge shown in phantom.
Figure 2:
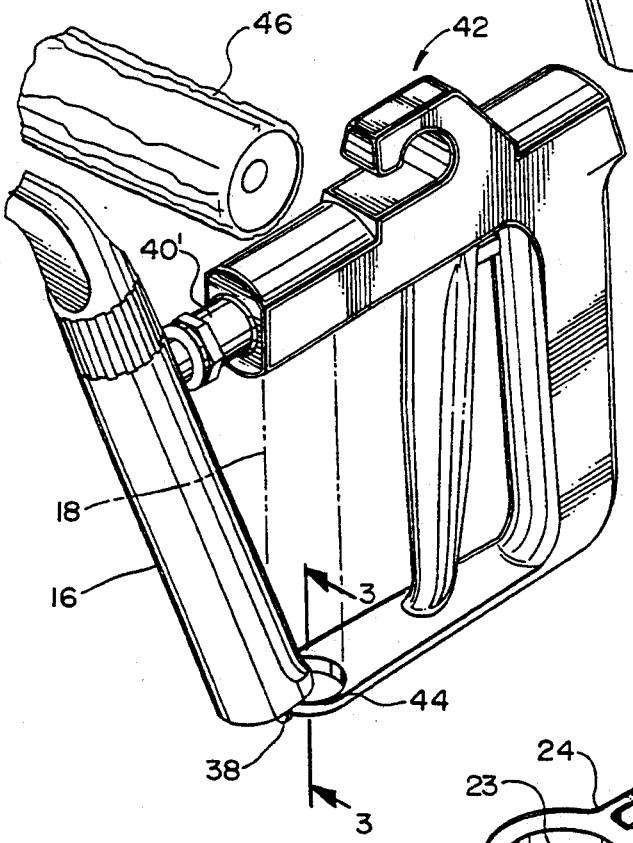
Fig. 2 PRIOR ART
FIG. 2 is a perspective view of a spray gun of the prior art with a support ring formed integral with the body of the gun, shown with a roller handle attached, and the position of an alternative in-line cartridge filter shown in phantom.
Figure 3:
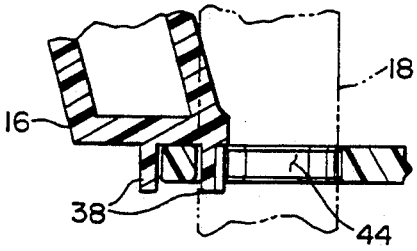
Fig. 3 PRIOR ART
FIG. 3 is a fragmentary sectional view of the spray gun of FIG. 2, taken along line 3—3, showing the alternative position of a roller arm (shown sectioned) or an in-line filter (shown in phantom).
Figure 6:
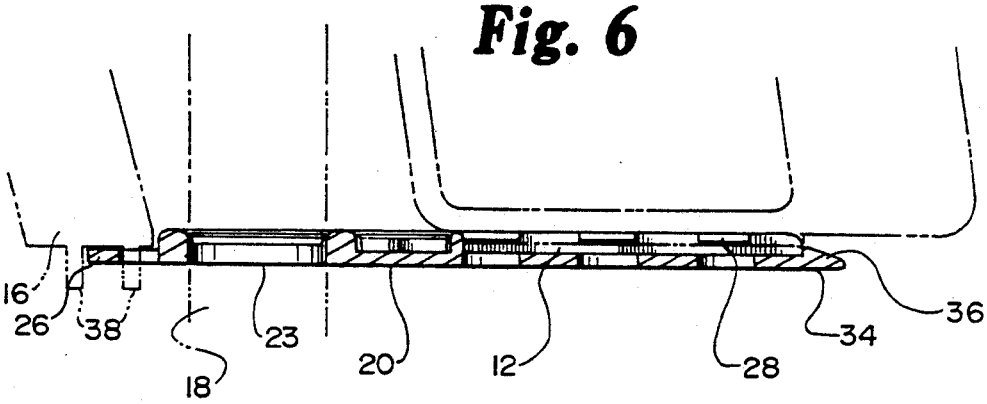
FIG. 6 is a sectional view of the roller arm guide taken along line 6—6 of FIG. 4 with the simultaneous use of both a spray gun handle and an in-line filter cartridge shown in phantom.

Referring now to FIGS. 1 and 6, there is illustrated a roller arm guide 10 according to the present invention, shown positioned on a track 12 on a base of a spray gun 14, with the roller arm 16 and an in-line filter 18 simultaneously supported by the roller arm guide 10. It is to be understood that the roller arm 16 is the same roller arm useable with the prior Model G-05 spray gun of Wagner Spray Tech Corporation, described herein above. Spray gun 14 has a specially designed track 12 on the base thereof, as shown in FIG. 3, and cooperates with guide 10 in the practice of the present invention, as will be described further hereinafter.

Figure 4:
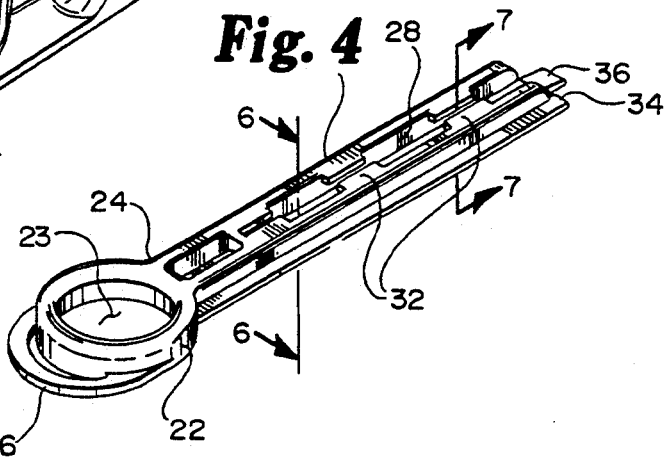
FIG. 4 is a perspective view of the roller arm guide of the present invention.
Figure 5:
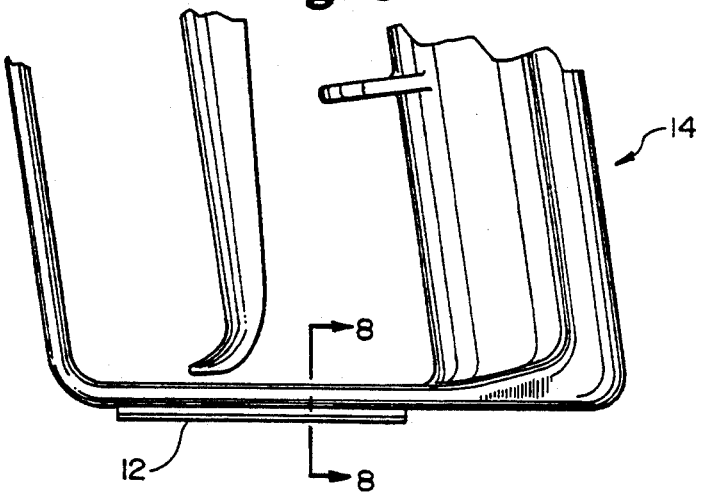
FIG. 5 is a fragmentary left side elevational view of the spray gun handle with the roller arm guide of the present invention removed from the track.
Figure 7:
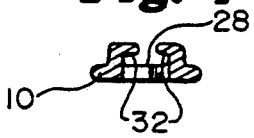
FIG. 7 is a sectional view of the roller arm guide taken along line 7—7 of FIG. 4.
Figure 8:
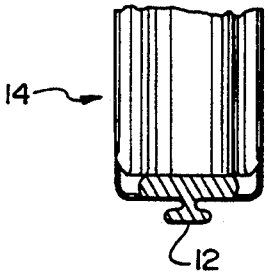
FIG. 8 is a sectional view of the track taken along line 8—8 of FIG. 5.
Figure 9:
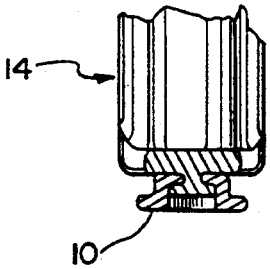
FIG. 9 is a sectional view of the roller arm guide in position on the track taken along line 9—9 of FIG. 1.

The roller arm guide 10, as best illustrated in FIGS. 1 and 4, has an elongated body 20 formed with a filter support ring 22 at a proximal end 24 of the body 20 and a generally crescent shaped roller arm engaging lip 26 formed on the exterior of the filter support 22. The elongated body 20, as shown in FIGS. 7 and 9, is interiorly formed with a channel member 28 to be closely and slidingly accommodated on the T-beam track 12, illustrated in FIGS. 8 and 9, on the base of the spray gun 14. The exterior of the elongated body 20 has slide clips 32 which complete the form of the channel member 28. At the distal end 34 of the elongated body 20 is a detent member 36 which snapretains the roller arm guide 10 when the roller arm guide 10 is slidingly engaged with the track 12. The roller arm guide 10 is preferably formed of a high impact plastic, such as polypropylene, impervious to paint, varnish, stains, shellacs and cleaning and diluting chemicals therefor.

In use, the roller arm guide 10 is moved along track 12 until the detent member 36 snap-engages the end of the track 12, to retain the roller arm guide 10 in place. A conventional cylindrical filter 18 may be inserted through an aperture 23 in the filter support ring 22 and connected to a paint inlet fitting 30 on the spray gun 14. It is to be understood that the filter 18 may be used with either the roller arm 16 or with a conventional spray tip attachment (not shown). On the base of the roller arm 16 are concentrically positioned arc-shaped flanges 38 which straddle the generally crescent shaped roller arm engaging lip 26. Engagement of the roller arm 16 to the paint outlet fitting 40 on the spray gun 14 completes the attachment of the roller arm 16 to gun 14. Attachment of a paint roller 46, illustrated in FIG. 1, completes the conversion of the paint spray gun to a paint roller. It is to be understood that, when the spray gun 14 is fitted with the roller arm 16, the use of the in-line filter 18 is optional.

The invention is not to be taken as limited to all of the details thereof as modifications and variations thereof may be made without departing from the spirit or scope of the invention.

What is claimed is:

1. A roller arm guide for a hand-held paint spray gun comprising:

an elongated body having a roller arm engaging lip and a filter support ring at a proximal end thereof, a detent member at a distal end thereof, and a slidingly engageable channel member therebetween, said roller arm guide adapted and arranged to be secured to a track on a base of the spray gun by sliding the channel member onto a proximal end of the track until the detent member is snap-retained by a distal end of the track, so that, when the roller arm guide is secured to the track, the roller arm engaging lip is positioned to support an arm of a paint roller while simultaneously supporting a filter attached to the paint spray gun by the filter support ring.

2. A roller arm guide according to claim 1, wherein the filter support ring is generally circular and the roller arm engaging lip is generally crescent-shaped, positioned exterior and proximal to the filter support ring.

3. A roller arm guide according to claim 1, wherein the roller arm engaging lip is arranged and adapted to support concentrically positioned flanges on a base of the roller arm.

4. A roller arm guide according to claim 1, wherein the channel of the roller arm guide comprises a generally T-shaped profile to closely accommodate a generally T-shaped cross-section of the track on the base of the spray gun.

5. A spray paint gun having a track on a base thereof in combination with a roller arm guide detachably mounted to said track, wherein said roller arm guide comprises an elongated body having a filter support ring and a roller arm engaging lip at a proximal end thereof, a detent member at a distal end thereof, and a slidingly engageable channel member therebetween, such that the roller arm guide may be secured to said track by sliding the guide channel member onto a proximal end of the track until the detent member is snap-retained by a distal end of the track, so that, when the guide is secured to the track, the roller arm engaging lip is positioned to support an arm of a paint roller and the filter support ring is positioned to support a filter attached to the spray paint gun.

6. The combination according to claim 5, wherein the roller arm is further attached to a paint outlet fitting of the paint spray gun.

7. The combination according to claim 5, wherein the filter support ring comprises a generally circular profile and the roller arm engaging lip is generally crescent-shaped, positioned exterior and proximal to the filter support ring.

8. The combination according to claim 7, wherein the roller arm engaging lip is arranged and adapted to support concentrically positioned flanges on a base of the roller arm.

9. The combination according to claim 5, wherein the track an the channel of the roller arm guide are both generally T-shaped.

10. A combined paint gun, paint roller arm and roller arm guide comprising:

a) a paint gun having:
   i) a base,
   ii) a track with proximal and distal ends formed on the base, and
   iii) a paint outlet fitting;

b) a roller arm guide detachably mounted on said track and having:
   i) an elongate body,
   ii) a roller arm engaging lip at a proximal end of the guide,
   iii) a detent member at a distal end of the guide engaging and detachably retaining the guide at the distal end of the track,
   iv) a channel member extending along the guide and slidingly engaging the track from the proximal end of the track at least to a region of the track intermediate the proximal and distal ends thereof, and
   v) a generally circular filter support ring located intermediate the roller arm engaging lip and the channel member;

c) a paint roller arm supported on the roller arm engaging lip and coupled to receive paint from the paint outlet fitting such that the roller arm is oriented and secured to the gun by the guide; and d) a paint filter attached to a paint inlet fitting of the gun and supported by the filter support ring simultaneously with the support of the roller arm by the roller arm engaging lip.

11. The combination of claim 10 wherein the roller arm engaging lip comprises a generally crescent-shaped member, positioned exterior and proximal to the filter support ring.

12. The combination according to claim 10, wherein the track and the channel of the roller arm guide are both generally T-shaped.

* * * * *

UNITED STATES PATENT AND TRADEMARK OFFICE

CERTIFICATE OF CORRECTION

PATENT NO. : 5,271,683

DATED : December 21, 1993

INVENTOR(S) : Mark E. Snetting and Steven A. Anderson

It is certified that error appears in the above-identified patent and that said Letters Patent is hereby corrected as shown below:

Claim 9, column 4, line 17, change "an" to --and--.

Signed and Sealed this

Twentieth Day of September, 1994

*Attest:*

*Attesting Officer*

Bruce Lehman

BRUCE LEHMAN

*Commissioner of Patents and Trademarks*